US005803882A

United States Patent [19]

Habing et al.

[11] Patent Number: 5,803,882

[45] Date of Patent: Sep. 8, 1998

[54] ARTICULATED UPPER ARM EXERCISER

[75] Inventors: Douglas J. Habing, Long Beach; Theodore G. Habing, Santa Ana, both of Calif.

[73] Assignee: Pacific Fitness Corporation, Cypress, Calif.

[21] Appl. No.: 865,217

[22] Filed: May 29, 1997

[51] Int. Cl.[6] ..... A63B 21/00

[52] U.S. Cl. ..... 482/136; 482/100; 482/137

[58] Field of Search ..... 482/99, 100, 133, 482/136–138

[56] References Cited

U.S. PATENT DOCUMENTS

| | | | |
|---|---|---|---|
| 4,387,893 | 6/1983 | Baldwin . | |
| 5,094,449 | 3/1992 | Stearns . | |
| 5,344,374 | 9/1994 | Telle . | |
| 5,486,150 | 1/1996 | Randolph | 482/137 X |

FOREIGN PATENT DOCUMENTS 2223686 10/1989 United Kingdom .

*Primary Examiner*—Richard J. Apley
*Assistant Examiner*—John Mulcahy
*Attorney, Agent, or Firm*—Blakely, Sokoloff, Taylor & Zafman

[57] ABSTRACT

An exercise machine has a pair of exercise arms pivotally coupled to the frame for use by the operator in performing a triceps press exercise. The exercise arms are coupled to the frame for rotation about two spaced-apart, generally horizontal axes. One axis is fixed with respect to the frame, while the second axis is fixed with respect to the exercise arms. A linkage member pivotally coupled to both the frame and the exercise arms connects the two axes of rotation. Exercise resistance is provided by weights, although other sources of exercise resistance may be used. The selected exercise resistance is transmitted by a flexible belt and pulley system to a cam attached to a cross member connecting the two exercise arms. A second belt is attached between the cam and the frame to control the movement of the cam within a vertical plane. As the operator applies an exercise force to the exercise arms, the arms rotate about both the first and second axes, the relative movement about the two axes being coordinated by the controlled movement of the cam. This method can also be applied to many other types of exercise machines involving a non-linear motion path, including, for example, machines for performing biceps, leg curl, and leg extension exercises.

10 Claims, 5 Drawing Sheets

ARTICULATED UPPER ARM EXERCISER

BACKGROUND OF THE INVENTION

1. Field of the Invention

This invention relates to the field of exercise equipment, and particularly to an apparatus for exercising the triceps and/or biceps muscles.

2. Prior Art

Weightlifting machines for exercising various muscle groups of the body are well-known. Such machines, particularly those intended for use by serious body builders, have become highly specialized. Some machines are designed to isolate a single muscle for exercise. For example, individual exercise machines are available for exercising only the biceps or triceps muscles of the arm. Prior exercise machines for exercising a single muscle typically have an exercise member that rotates about a single pivot.

Certain muscles of the human body are involved when limbs are moved at more than a single joint. For example, the biceps and triceps muscles are located between the elbow and shoulder joints. Typical prior art exercises for these muscle groups restrict movement of the arm to the elbow joint only. While movement at the elbow joint causes the greatest contraction of these muscles, the biceps muscle can also be exercised by locking the elbow joint and lifting the arm against resistance by rotation solely at the shoulder joint. Likewise, the triceps muscle can be exercised by locking the elbow joint and pushing down against resistance with rotation solely at the shoulder joint. However, the biceps and triceps muscles can be more completely and effectively exercised when both the elbow and shoulder joints are rotated with a large degree of rotation at the elbow joint and a proportionately smaller amount of rotation at the shoulder joint.

SUMMARY OF THE INVENTION

The present invention provides an exercise machine that is specially designed to exercise the triceps muscles, although the same design can be used to exercise the biceps muscles with only slight alteration. The exercise machine comprises a frame with a seat for the operator. A pair of exercise arms are pivotally coupled to the frame for use by the operator in performing a press exercise. The exercise arms are coupled to the frame for rotation about two spaced-apart, generally horizontal axes. One axis is fixed with respect to the frame, while the second axis is fixed with respect to the exercise arms. A linkage member pivotally coupled to both the frame and the exercise arms connects the two axes of rotation.

Exercise resistance is provided by weights, although other sources of exercise resistance may be used. The selected exercise resistance is transmitted by a flexible belt and pulley system to a cam attached to a cross member connecting the two exercise arms. A second belt is attached between the cam and the frame to control the movement of the cam within a vertical plane. As the operator applies an exercise force to the exercise arms, the arms rotate about both the first and second axes, the relative movement about the two axes being coordinated by the controlled movement of the cam.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
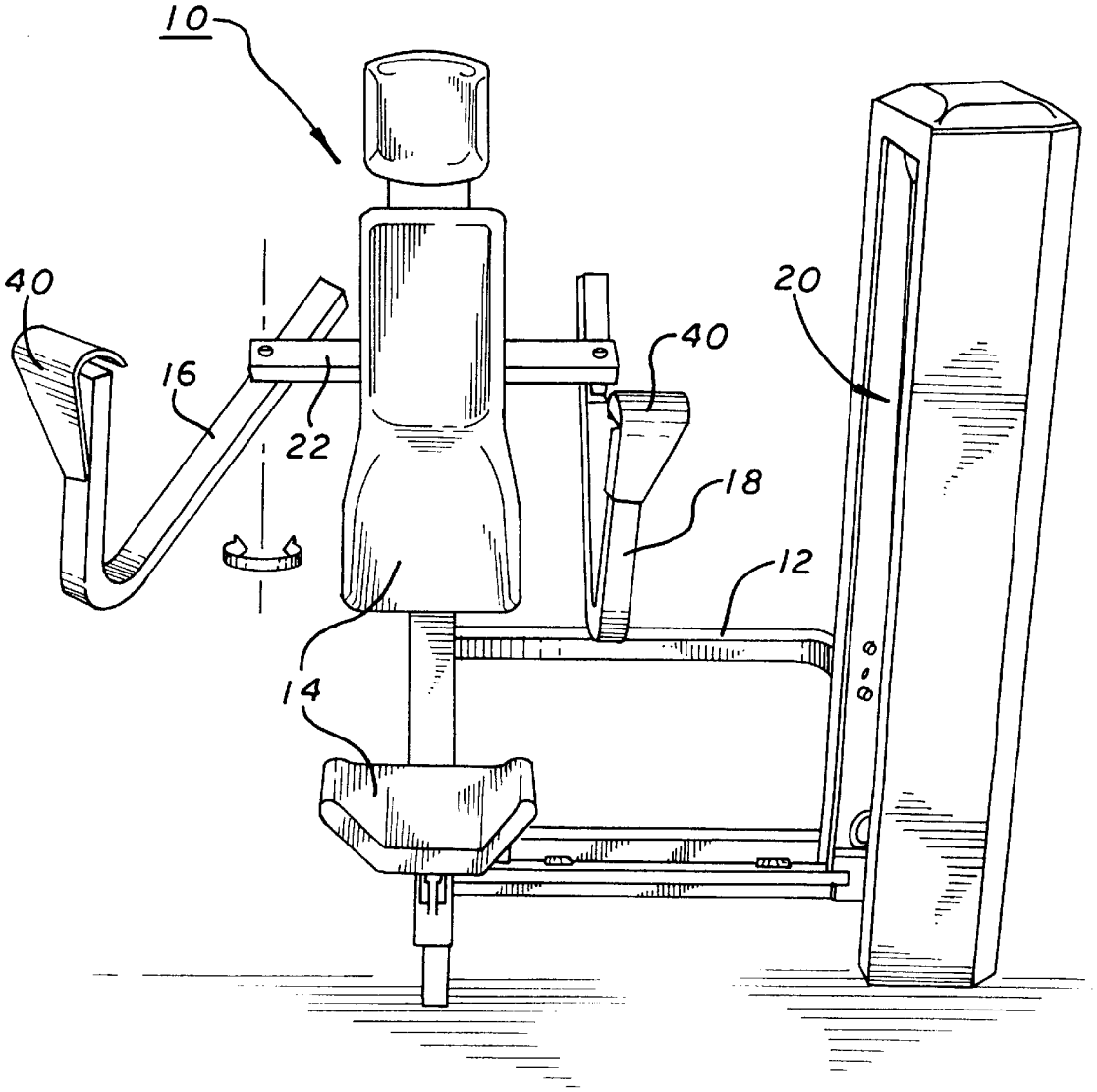
FIG. 1 is a front perspective view of an exercise apparatus according to the present invention.

The exercise apparatus of the present invention is illustrated generally in FIG. 1. Apparatus 10 comprises a frame 12, to which is attached seat 14. Also attached to the frame are a pair of exercise arms 16 and 18, which are pivotally coupled to cross member 22. Each of arms 16 and 18 pivot freely towards or away from the seat within a plane defined by the two arms to provide a comfortable gripping position for the operator. This plane rotates horizontally during the exercise stroke as explained below. Exercise resistance is provided by a selectable weight stack 20; however, conventional weight plates could be loaded onto exercise arms 16 and 18. Other sources of exercise resistance may also be utilized, including hydraulic, pneumatic, electromagnetic, friction or even the operator's own body weight.

Figure 2:
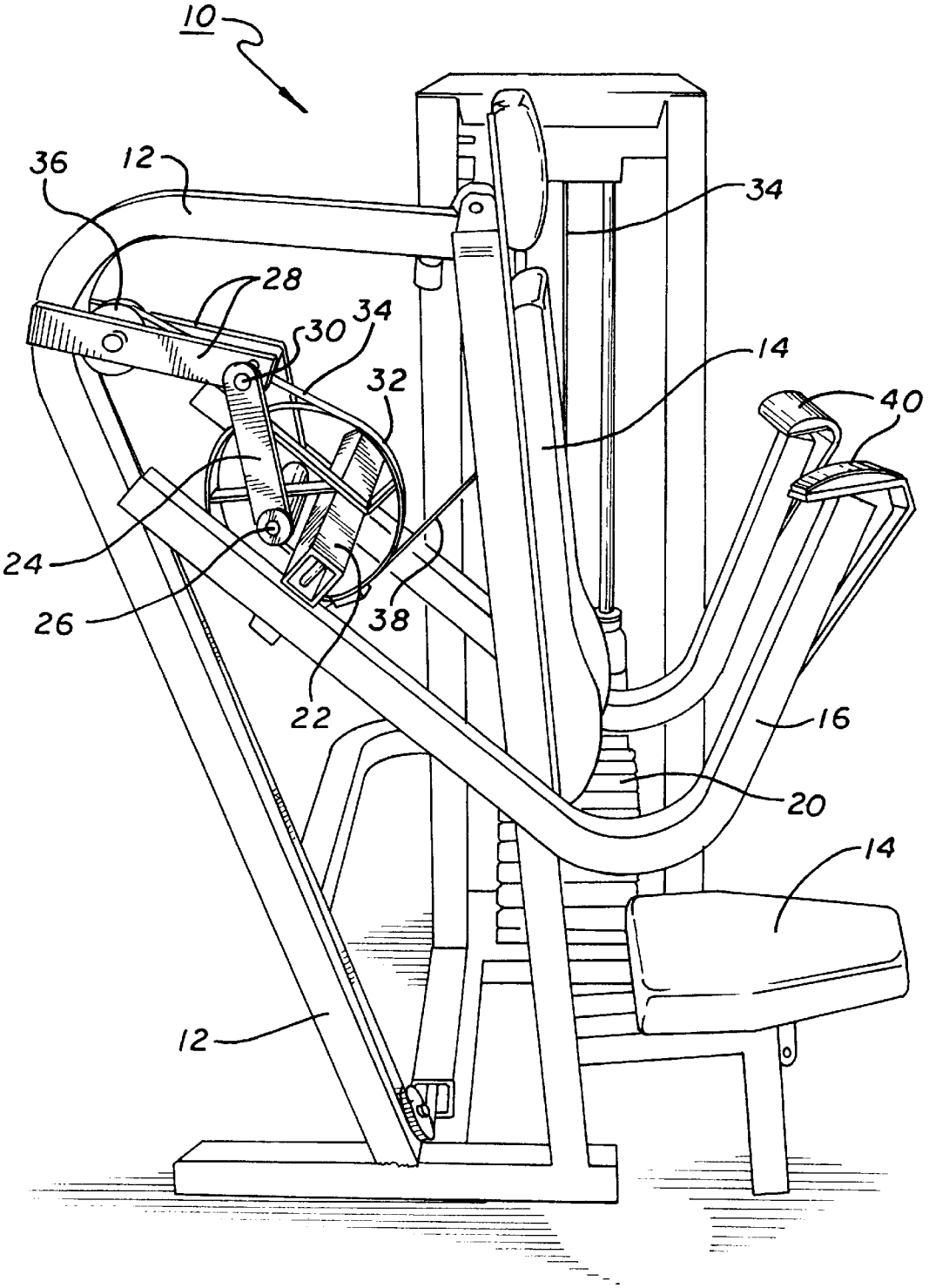
FIG. 2 is a side perspective view of the exercise apparatus of FIG. 1.
Figure 7:
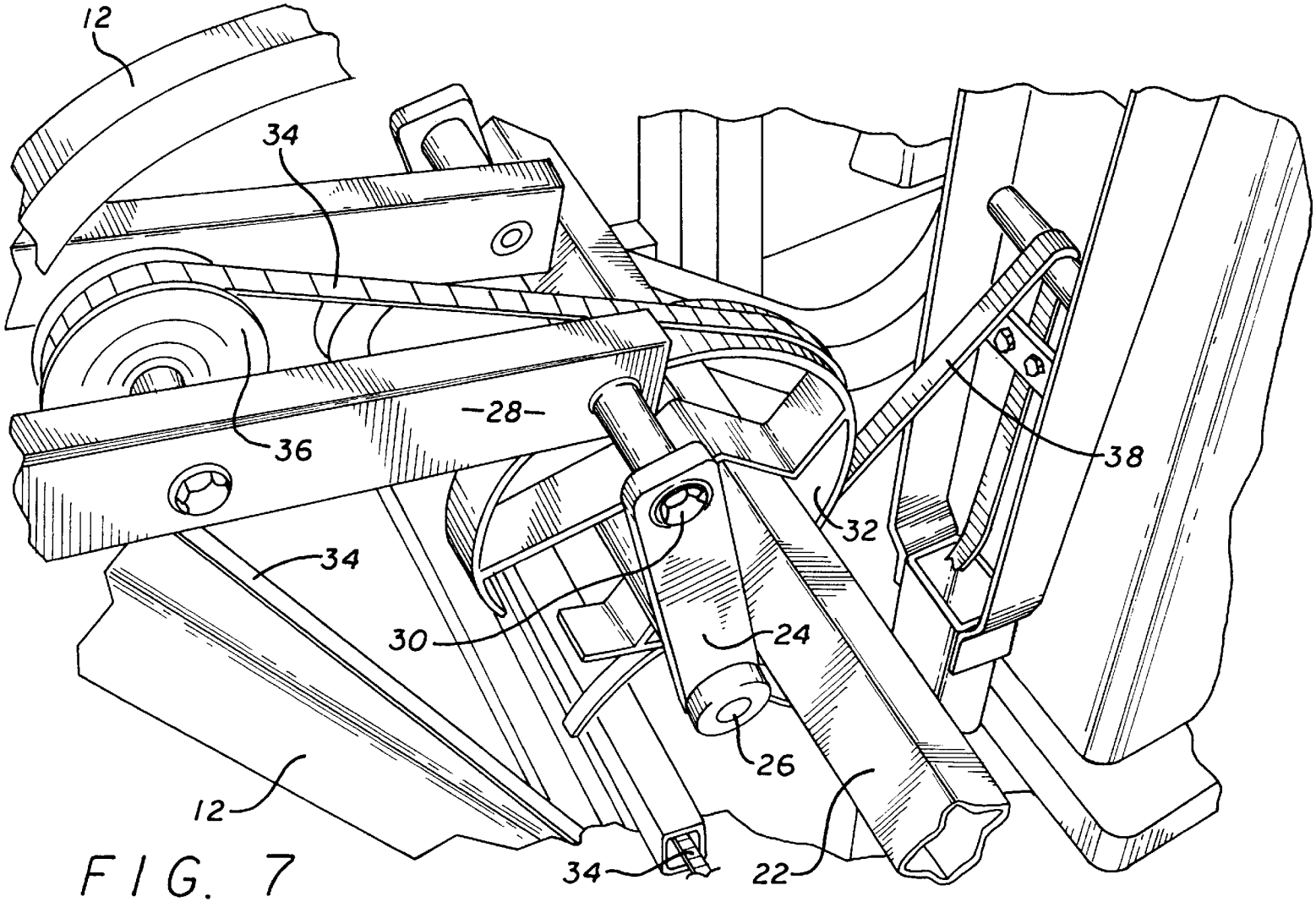
FIG. 7 is a detailed view of the cam and linkage assembly of the apparatus of FIG. 1.

Referring now to FIGS. 2 and 7, cross member 22 is suspended from link arms 24 at pivot 26. Link arms 24 are pivotally coupled to bracket 28 at pivot 30. Bracket 28 is welded or otherwise suitably fixed to frame 12.

A cam 32 is secured to cross member 22. A belt 34 is guided over the outer surface of cam 32. Belt 34 is routed over pulley 36 and is ultimately connected to weight stack 20. A second belt 38 is attached at one end to cam 32. The other end of belt 38 is attached to frame 12 behind seat 14. This second belt serves to limit the travel of link arm 24 while in tension and hence also controls the vertical travel of cross member 22 and of exercise arms 16 and 18. As illustrated in FIG. 2, belt 38 is in tension, preventing further downward rotation of the exercise arms about pivot 26.

Figure 4:
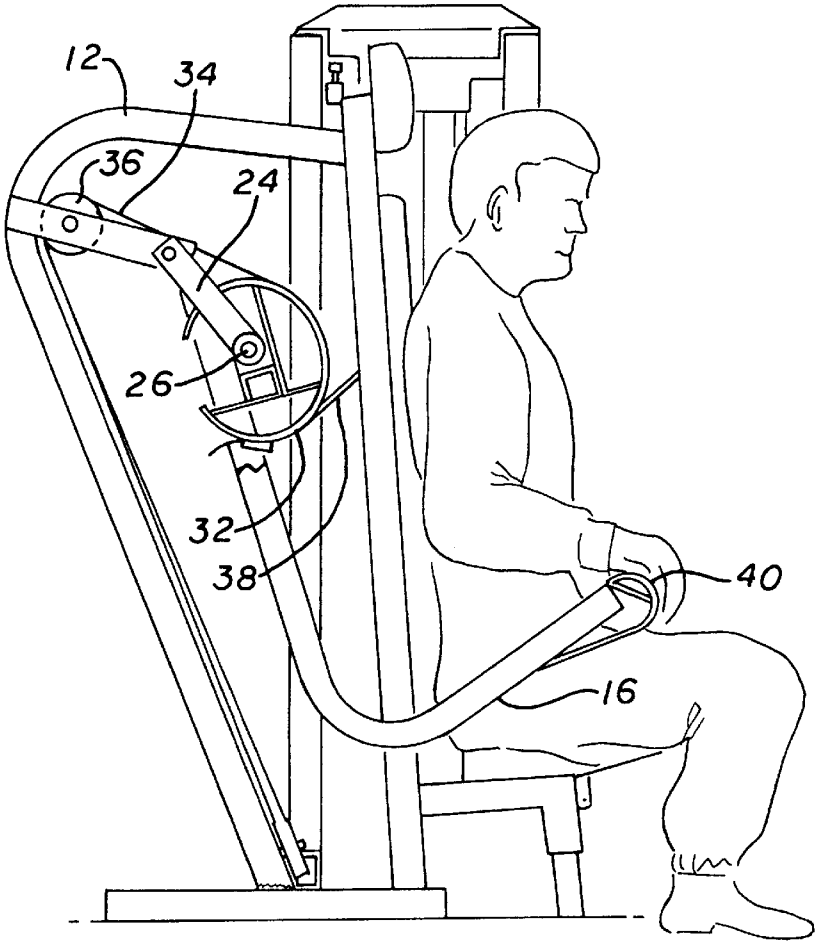
FIG. 4 illustrates a first intermediate position of a triceps exercise performed on the apparatus of FIG. 1.
Figure 3:
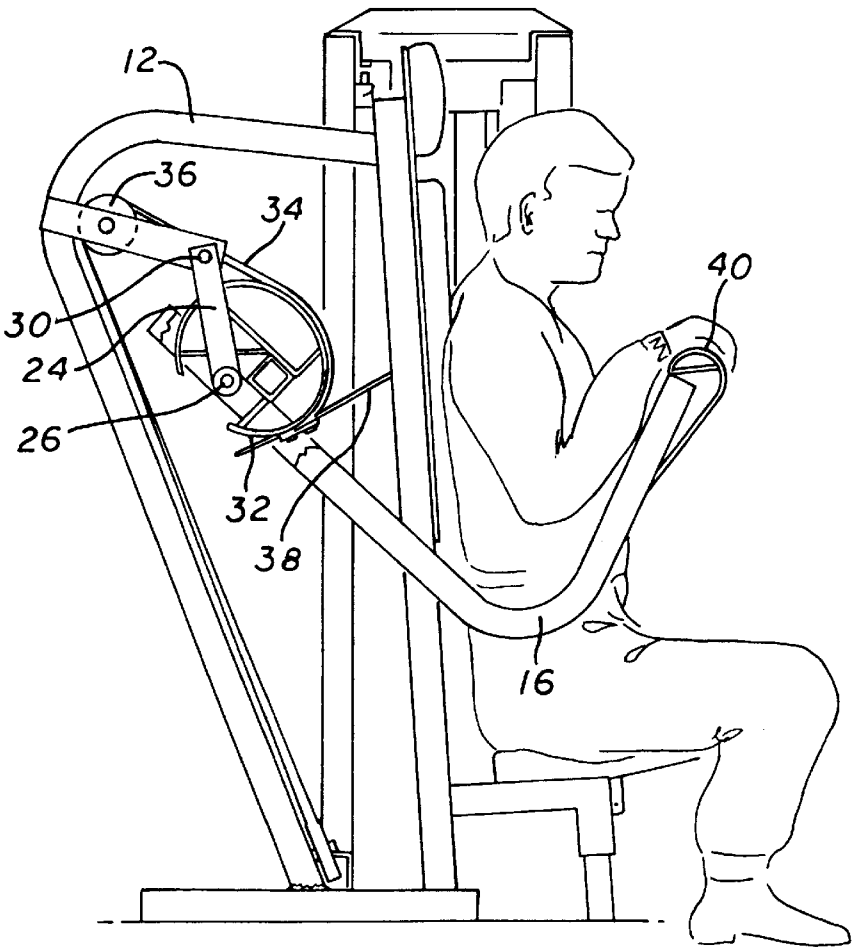
FIG. 3 illustrates the starting position of a triceps exercise performed on the apparatus of FIG. 1.

FIG. 3 illustrates the beginning position of a triceps exercise utilizing apparatus 10. The operator is seated in seat 14 and the operator's hands are placed on handgrips 40 secured to exercise arms 16 and 18. Referring next to FIG. 4, the operator presses downwardly on the exercise arms, thereby contracting the triceps muscles. Cam 32 is drawn forwardly and upwardly as cross member 22 rotates about pivots 26 and 30. The combination of rotational and translational movement of cam 32 causes belt 34 to lift the selected weights of weight stack 20.

Figure 6:
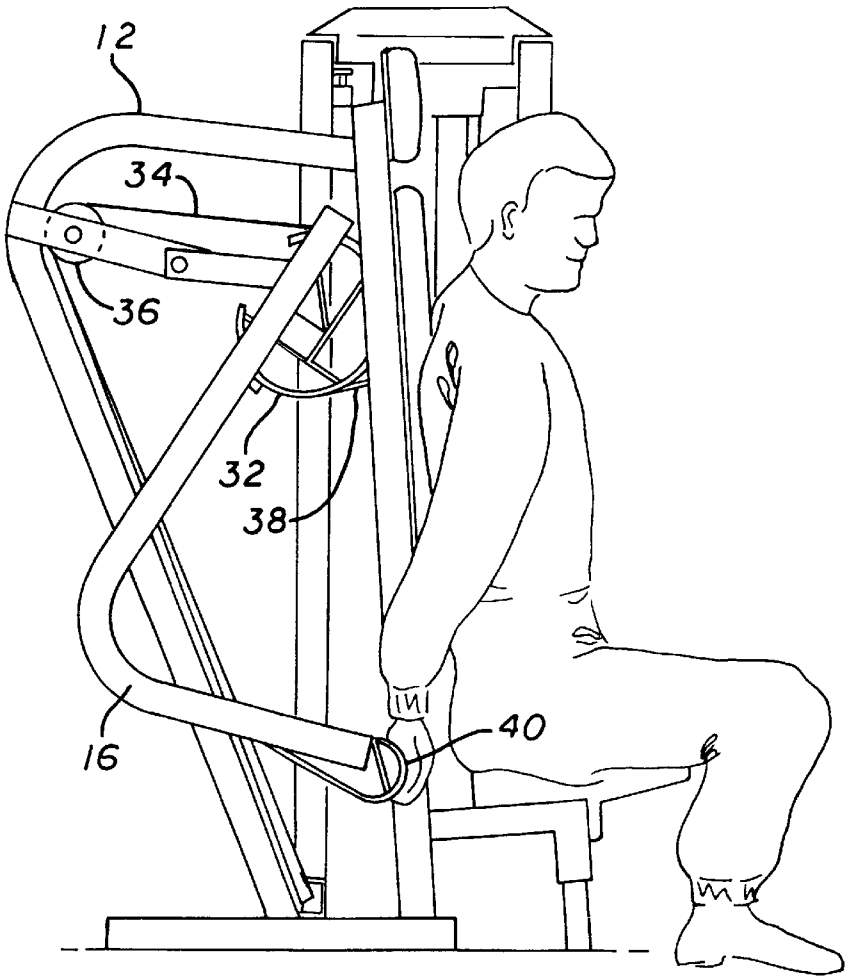
FIG. 6 illustrates the ending position of a triceps exercise performed on the apparatus of FIG. 1.
Figure 5:
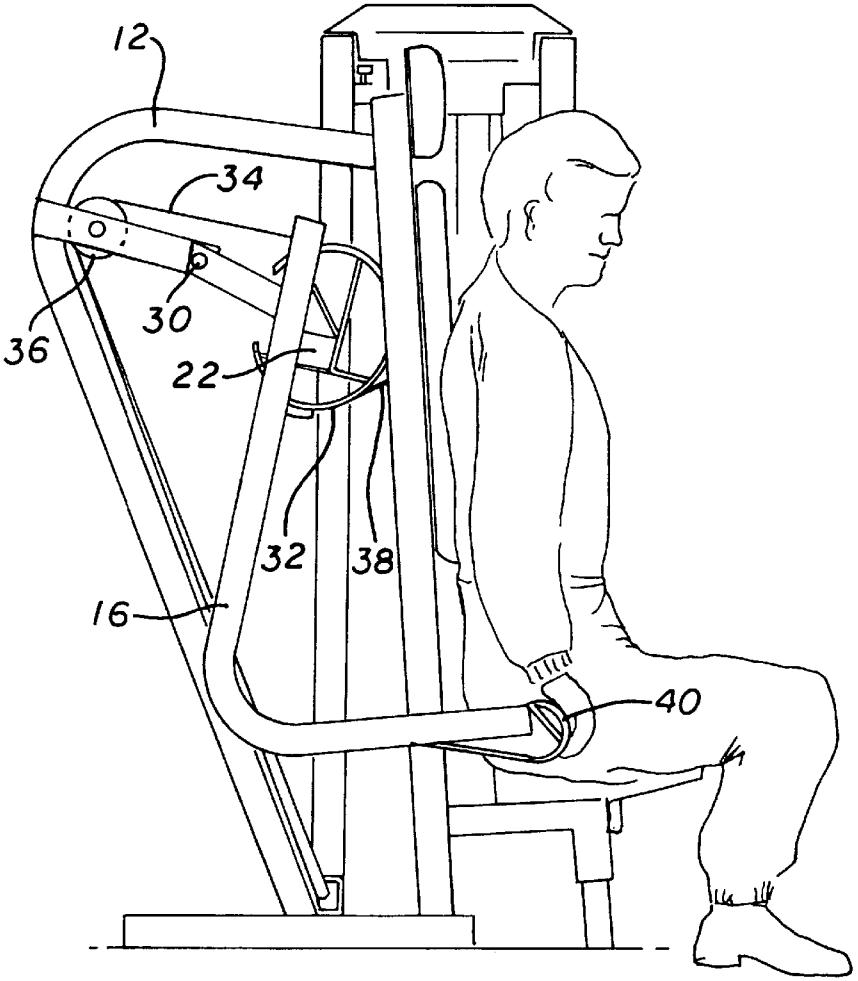
FIG. 5 illustrates a second intermediate position of a triceps exercise performed on the apparatus of FIG. 1.

Referring next to FIG. 5, handgrips 40 have been brought down to their lowermost positions in the exercise stroke. Cross member 22 and cam 32 continue to rotate about both pivots 26 and 30 as can be seen by the position of link arms 24. The exercise stroke continues as shown in FIG. 6 with a triceps kickback in which the operator's elbow joints are locked and the operator is pushing rearwardly with further rotation at the shoulder joint.

It will be observed that, in the course of performing the entire exercise stroke, there has been approximately 160° of rotation at the operator's elbow joints with involvement of the operator's shoulder joints as well, thereby fully exercising the triceps muscles.

Although the present invention has been described in terms of a specific embodiment using cam 32 and belt 38 to coordinate the relative movement of exercise arms 16 and 18 about the axes of rotation defined by pivots 26 and 30, other means may be employed. For example, additional linkage members could be pivotally coupled between the frame and the exercise arms to accomplish the same function.

The above-described embodiment of the present invention is specially designed for performing a triceps press exercise. It will be appreciated that the same machine may be adapted to exercise the biceps muscles by providing resistance to upward motion of exercise arms 16 and 18. For a biceps exercise, the starting position would be essentially as shown in FIG. 6 and the ending position would be essentially as shown in FIG. 3. The invention may also be utilized for exercising other muscle groups of the body. For example, the invention may be embodied in a similarly constructed machine for performing leg extension and/or leg curl exercises.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. An exercise apparatus comprising:

a frame;

a support attached to the frame for supporting a user of the apparatus;

an exercise arm pivotally coupled to the frame for simultaneous rotation about a first axis and a second axis;

means for supplying exercise resistance;

resistance communication means coupled to the means for supplying exercise resistance and acting directly on the exercise arm to resist rotation about the first and second axes;

means for coordinating relative movement of the exercise arm about the first and second axes as the user applies an exercise force to the exercise arm, wherein the means for coordinating relative movement of the exercise arm about the first and second axes comprises a cam disposed around the second axis.

2. The exercise apparatus of claim 1 wherein the exercise arm is coupled to a generally horizontal cross member and said cam is rigidly attached to said cross member.

3. The exercise apparatus of claim 2 further comprising a linkage member pivotally coupled to the frame on said first axis and pivotally coupled to the cross member on said second axis.

4. The exercise apparatus of claim 1 wherein said resistance communication means comprises a first flexible member that is guided on said cam.

5. The exercise apparatus of claim 4 wherein the means for coordinating relative movement of the exercise arm about the first and second axes further comprises a second flexible member coupled at one end thereof to the frame and at an opposite end thereof to the cam.

6. An exercise apparatus comprising:

a frame;

a support attached to the frame for supporting a user of the apparatus;

a pair of exercise arms pivotally coupled to the frame for movement about a first axis and a second axis;

a linkage member pivotally coupled to the frame on said first axis;

a cross member connecting said pair of exercise arms and pivotally coupled to the linkage member on said second axis;

means for supplying exercise resistance;

resistance communication means comprising a first flexible member coupled to the means for supplying exercise resistance;

a cam secured to said cross member, said flexible member guided on a surface of the cam;

means for controlling motion of said cam so as to coordinate relative movement of the exercise arms about the first and second axes as the user applies an exercise force to the exercise arms.

7. The exercise apparatus of claim 6 wherein the means for controlling motion of the cam comprises a second flexible member coupled at one end thereof to the frame and at an opposite end thereof to the cam.

8. The exercise apparatus of claim 6 wherein the first axis is parallel to the second axis.

9. The exercise apparatus of claim 8 wherein the first axis is spaced apart from the second axis.

10. The exercise apparatus of claim 8 wherein the first and second axes are generally horizontal.

* * * * *